US012268927B2

(12) United States Patent
Anani

(10) Patent No.: US 12,268,927 B2
(45) Date of Patent: Apr. 8, 2025

(54) MULTI-FUNCTION RESISTANCE TRAINING APPARATUS

(71) Applicant: Suhaib M. I. Anani, Dubai (AE)

(72) Inventor: Suhaib M. I. Anani, Dubai (AE)

( * ) Notice: Subject to any disclaimer, the term of this patent is extended or adjusted under 35 U.S.C. 154(b) by 670 days.

(21) Appl. No.: 16/952,111

(22) Filed: Nov. 19, 2020

(65) Prior Publication Data

US 2021/0162256 A1 Jun. 3, 2021

(30) Foreign Application Priority Data

Nov. 28, 2019 (GB) ..... 1917325

(51) Int. Cl.

| | |
|---|---|
| ***A63B 21/00*** | (2006.01) |
| ***A63B 21/005*** | (2006.01) |
| ***A63B 21/062*** | (2006.01) |
| ***A63B 24/00*** | (2006.01) |

(52) U.S. Cl.

CPC ..... *A63B 21/4047* (2015.10); *A63B 21/00* (2013.01); *A63B 21/0058* (2013.01); *A63B 21/062* (2013.01); *A63B 21/0628* (2015.10); *A63B 21/154* (2013.01); *A63B 21/157* (2013.01); *A63B 21/159* (2013.01); *A63B 21/4035* (2015.10); *A63B 21/4049* (2015.10); *A63B 24/0062* (2013.01); *A63B 24/0087* (2013.01); *A63B 2209/08* (2013.01); *A63B 2220/17* (2013.01); *A63B 2225/093* (2013.01); *A63B 2225/20* (2013.01)

(58) Field of Classification Search

CPC ..... A63B 21/0628; A63B 21/4035; A63B 21/4049; A63B 21/00; A63B 21/0058; A63B 21/062; A63B 21/154; A63B 21/157; A63B 21/159; A63B 24/0062; A63B 24/0087; A63B 2209/08; A63B 2220/17; A63B 2225/093; A63B 2225/20

See application file for complete search history.

(56) References Cited

U.S. PATENT DOCUMENTS

| | | | | |
|---|---|---|---|---|
| 5,308,303 A * | 5/1994 | Rawls | ..... | A63B 24/00 482/137 |
| 2007/0054785 A1 * | 3/2007 | Drechsler | ..... | A63B 21/156 482/94 |

* cited by examiner

*Primary Examiner* — Sundhara M Ganesan
*Assistant Examiner* — Jacqueline N L Loberiza
(74) *Attorney, Agent, or Firm* — Theodore P. Cummings

(57) ABSTRACT

The invention relates to a resistance training apparatus and more specifically, but not exclusively, to a multi-function resistance training apparatus. The apparatus includes a primary unit, biasing unit, and accessory exchanger unit. The primary unit includes at least one resistance training member extending from the unit. The resistance training members are movable to adjust its height and is mechanically connected to biasing means which resists movement of the resistance training member. The biasing unit is removably attached to the primary unit by interlocking attachment members and provides the necessary bias to the primary unit. The accessory exchange unit may be used to exchange accessories for use with the resistance training member. The apparatus includes a plurality of actuators and motors to automate many of the functions of the apparatus from a remote device.

9 Claims, 19 Drawing Sheets

MULTI-FUNCTION RESISTANCE TRAINING APPARATUS

FIELD OF THE INVENTION

The invention relates to a resistance training apparatus and more specifically, but not exclusively, to a multi-function resistance training apparatus.

BACKGROUND TO THE INVENTION

Strength training is important for maintaining a healthy lifestyle and is practiced by many people (including athletes) as part of a regular fitness routine. Weight training is a common form of strength training and includes exercises using free weights or weight machines.

Weight machines (with some variants also referred to as cable machines) are useful in that the machines are adjustable to allow for various loads to be used in a single machine as opposed to free weights which require a weight, or set of weights, for every discreet load a user may require.

One of the disadvantages of weight machines is that such machines are often targeted at a specific exercise aimed at a specific muscle group of the human body. A user will thus need access to many machines to practice a balanced weight training routine. These machines are often relatively large and occupy floor space which might have been used for other purposes. Further, any institution wishing to offer its user access to such machines, would have to purchase many machines requiring larger upfront investment.

Another disadvantage of weight machines is that they are frequently not adjustable to cater for users of different physical size.

OBJECT OF THE INVENTION

It is accordingly an object of the invention to provide resistance training apparatus which, at least partially, alleviates at least some of the disadvantages associated with the prior art.

SUMMARY OF THE INVENTION

In accordance with the invention there is a resistance training apparatus comprising:

- a primary unit including a resistance training member extending from the primary unit;
- the resistance training member being movable longitudinally relative to the primary unit and securable at a position along the axis of longitudinal movement;
- the resistance training member being rotatable about a two perpendicular axes, both which are transverse to the axis of longitudinal movement and rotationally settable to a desired position;
- such that, when the resistance training member is set to the desired position, it is mechanically connected to a biasing unit which resists rotation of the resistance training member.

The resistance training member is an arm which is movable and securable longitudinally along the height of the primary unit such that the arm may be secured at a desired height.

The arm includes two shafts one hollow shaft enclosing a solid shaft at one end thereof, where the arm extends transversely from the shaft and is rotatable about the shaft.

The arm includes an accessory attachment element at the other end thereof for attaching an accessory to the arm such that the accessory may be engaged by a user and resists rotation.

The arm may include a secondary accessory attachment element for attaching an accessory transverse to the arm.

The arm is rotationally settable through a frictional element such as a clutch.

The rotation and movement of the arm and the engagement of the clutch may be actuated and controlled through a control unit. The control unit may be an electronic control unit (ECU) and the actuation is performed through electric motors controlled by the ECU.

The shaft of the arm may include a mechanical connection to the biasing unit wherein disengagement of the clutch mechanically disconnects the arm from the biasing unit.

The apparatus may include a secondary resistance training member extending from the primary unit. The secondary resistance training member is mechanically connected to the biasing unit to resist movement of the member. The secondary resistance training member may be in the form of a rope extending from the unit with a free end of the rope resisting further extension from the unit.

The free end of the rope may include an accessory attachment element for attaching an accessory to the free end of the rope. The accessory may be a handlebar wherein a user engages the handlebar which resists movement through the rope.

The mechanical connection between the resistance members and the biasing unit may include ropes and pulleys. The biasing unit may include stacked weights which are movable upward and provides downward resistance through its weight. The biasing unit may alternatively include a resistance motor.

The arm has bidirectional rotational resistance through a mechanical connection which includes a shaft, a disk, and a tensioned rope pivotally attached to the periphery of the disk such that torsional resistance is created in the shaft whenever the shaft and disk is rotated from an equilibrium point in either direction. The arm is releasably connected to the shaft and disk through gears which may be disengaged.

The arm is attached to an intermediate plate within the primary unit. The intermediate plate is movable relative on linear guides. The linear guides may include a pair of rack and pinion gearsets which linearly move the intermediate plate up and down within the primary unit to adjust the height of the arm.

The biasing unit includes compensation means to ensure that the tension in the rope is maintained as the plate and arm move upwards and downwards. The compensation means includes a spool, wherein one end of the tensioned rope is attached and wound to the spool.

The secondary resistance member may extend from a carriage with guide pulleys mounted on the carriage. The carriage may be movable upward and downward with respect to the primary unit such that the height of the exit point of the rope may be adjusted. The carriage is movable along a tubular guide with a rounded L-shape to allow the secondary resistance member to extend from the unit horizontally or vertically depending on the position of the carriage along the guide.

The primary unit may contain compensation means for maintaining rope tension as the carriage is moved upward, downward, or transversely along the horizontal part of the tubular guide.

The apparatus may include one or more biasing units which are removably connected to the primary unit. The biasing unit may be connected to the primary unit through complementary interlocking attachment members.

The biasing unit may include biasing means in the form of stacked weights which may be selectively engaged to adjust the weight such that the bias may be transferred through a rope and pulleys. The free end of the rope may include one of the complementary interlocking attachment members which is attachable to its counterpart on the primary unit.

The biasing unit may include actuators which are moveable relative to the stacked weights and may selectively engage a number of stacked weights by inserting a locking member to lock a number of weights to the weighted end of the rope. The locking member may be a pin.

The actuator is moveable through a carriage which moves on linear guides in the form of a rack and pinion. The carriage may be actuated. The actuators may be electric motors which are operated by an electronic control unit. The carriage may move the actuator to a desired position, such that when the actuator is actuated in the desired position, a number of weights are locked to the weighted end of the rope. The carriage may include engaging members to engage the weighted end of the rope such that, when the free end of the rope is extended, the carriage moves upward along with the selectively engaged weights to resist extension of the free end.

The complementary interlocking attachment members may include a hollow frustoconical housing with a rope secured to the apex side of the housing.

The primary unit and biasing unit may have recesses formed therein which are shaped and sized to receive the housing such that the housing is self-centering and self-aligning.

The interlocking attachment members may include an actuation socket which, when engaged, actuates the interlocking mechanism to attach and interlock the members to each other.

The apparatus may include an accessory exchanger unit which detaches, stores, and attaches accessories to one of the accessory attachment elements of the arm. The accessory exchanger unit includes a stack of accessory units, each equipped with a number of actuators for unlocking, detaching, storing, changing, attaching and locking an accessory to the accessory attachment element of the arm.

The primary-, biasing-, and accessory exchanger units may include motorized wheels such that the units may be independently moved. The units may further include securing formations and mechanisms such that the units may be secured to a base or floor.

The actuators of the apparatus may be controlled through a number of electronic control unites (ECUs) which include communication means for controlling the apparatus from a remote device. The ECUs may also measure movement of the various actuators.

The remote device may include a user interface which includes one or more controls for:

- moving each of the units;
- engaging and disengaging a biasing unit to a primary unit by actuating the complementary interlocking members;
- adjusting the rotational position and height of the arm;
- disengaging the biasing unit from the arm;
- adjusting height of the carriage of the secondary resistance training member;
- adjusting the weight to be engaged by a biasing unit; and
- selecting and initiating the exchange of an accessory. The user interface may include features for storing:
  - a profile of a user including physical dimensions of the user;
  - a selected exercise, accessory, and weight;
  - number of repetitions completed for a selected exercise.

BRIEF DESCRIPTION OF THE DRAWINGS

An embodiment of the invention is described below, by way of a non-limiting example only, and with reference to the accompanying drawings in which.

DETAILED DESCRIPTION

Figure 1:
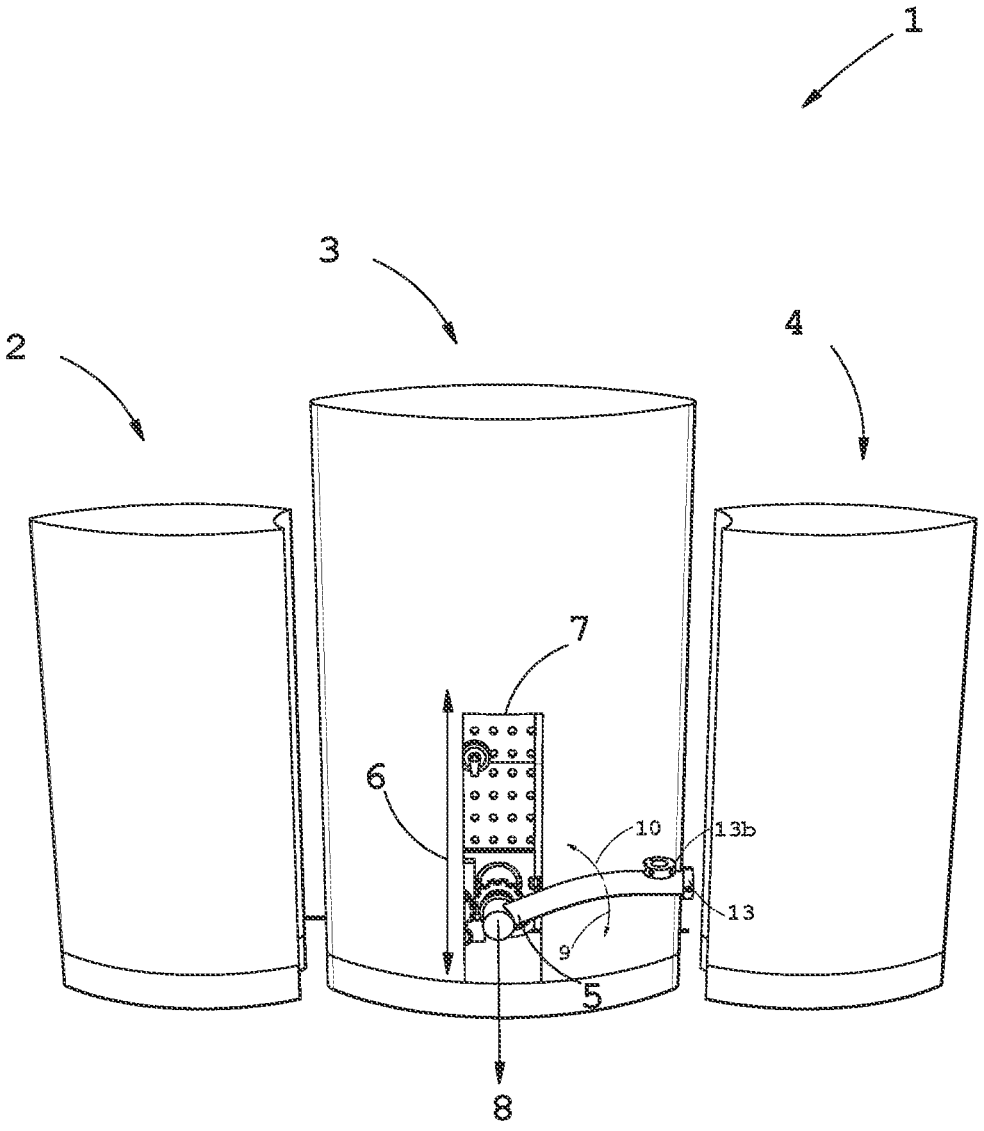
FIG. 1 is a schematic perspective view of a resistance training apparatus.
Figure 2:
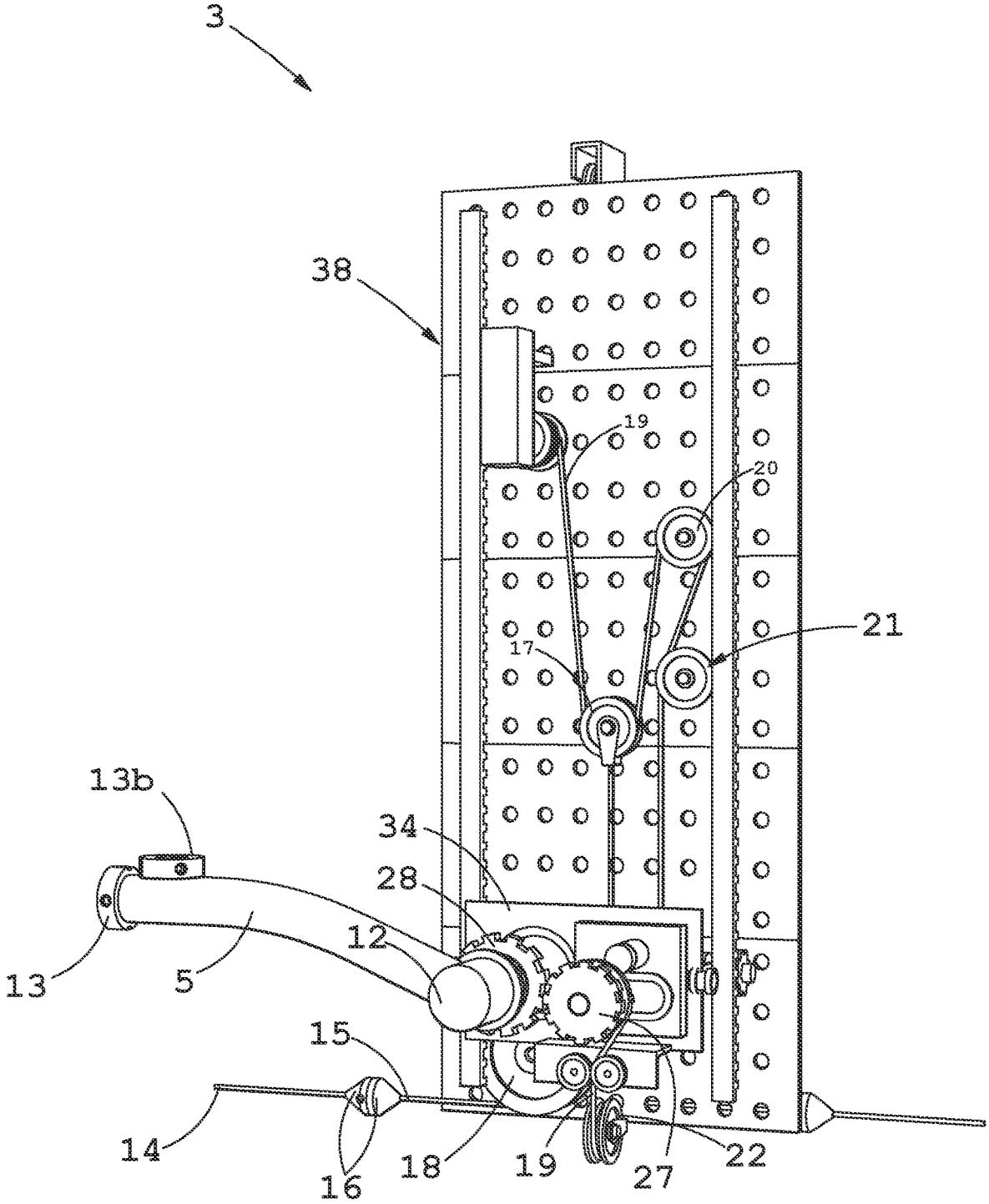
FIG. 2 is a schematic perspective view of part of a primary unit.

With reference to the drawings, in which like features are indicated by like numerals, a resistance training apparatus is generally indicated by reference numeral 1.

The apparatus 1 includes three major parts: a primary unit 3, a biasing unit 2, and an accessory exchanger unit (AXU) 4 which is shown in one configuration in FIG. 1. The primary unit 3 includes a resistance training member 5 extending from the primary unit 3. The resistance training member 5 is movable longitudinally relative to the primary unit 3 and is securable at a position along the axis of longitudinal movement. In this example the resistance training member is in the form of an arm 5 which is movable and securable longitudinally along the height (along direction 6) of the primary unit such that the arm may be secured at a desired height. For this purpose, the housing of the primary unit 3 includes a rectangular aperture 7 to facilitate the upward and downward movement of the arm 5. The arm 5 is rotatable about an axis 8 which is perpendicular to the axis of longitudinal movement 6 and rotationally settable to a desired position. Arm 5 can also be rotatable around an axis perpendicular to axis 8 by means of a bevel gear 116. The arm 5 may be rotated clockwise 9 or counter clockwise 10 in order to reach the desired position and when the arm 5 is set to the desired position, it is mechanically connected to biasing unit which resists rotation thereof. This allows the arm 5 (or accessories 11 attached thereto as described further below) to be engaged by a user and used for resistance training exercises.

The apparatus includes an accessory exchanger unit 4 which detaches, stores, and attaches accessories 11 to one of the accessory attachment elements 13 of arm 5. Accessory exchanger unit 4 includes a stack of accessory units 11, each equipped with a number of actuators 25 for unlocking, detaching, storing, changing, attaching and locking an accessory 11 to the accessory attachment element 13 of arm 5.

The arm 5 includes a hollow shaft 12 which encloses an inner solid shaft 119A and is connected to the arm 5 by means of a bevel gear 116 at one end thereof and the main portion of the arm 5 extends transversely from the hollow shaft 12 such that the arm 5 may rotate about the hollow shaft 12 and rotate around an axis perpendicular to the hollow shaft 12 by means of a shaft 101 in the bevel gear 116. The arm 5 includes an accessory attachment element 13 at the other end thereof for attaching an accessory 11 to the arm 5. The arm 5 may include an alternative accessory attachment element 13*b* for attaching an accessory 11 transverse to the arm 5. Alternatively, a single accessory attachment element 13 may be mounted on a ball and socket, universal, or gimballed connection which can rotate axially and transversely at the free end of arm 5.

Another version of the arm 5 rotation may include one shaft 12, where arm 5 rotates around shaft 12 only.

When the arm 5 is set, it is mechanically connected to biasing unit 2, which in the current example is provided by the biasing unit 2 through rope 14 which is attached to rope 15 through complementary interlocking attachment members 16. The tension in rope 15 is transferred to pulley 17 through pulley 18. Pulley 17, in turn, engages rope 19 which connects the compensation means 38 through pulleys (17, 20, 21, and 22) to the bidirectional rotational resistance element 23 (which is in turn mechanically connected to the arm 5).

Figure 3:
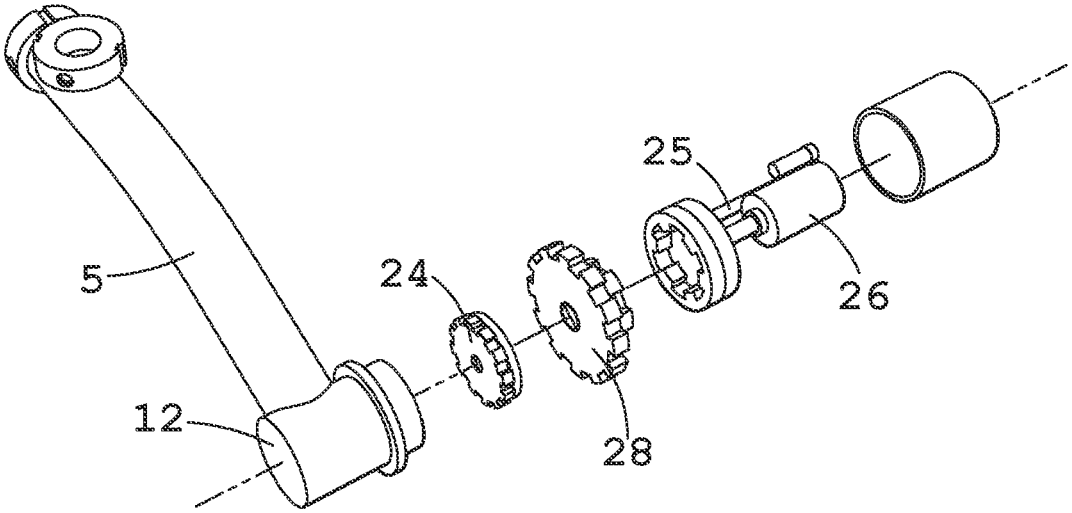
FIG. 3 is a schematic exploded perspective view of part of a primary unit including a resistance member with related parts.
Figure 4:
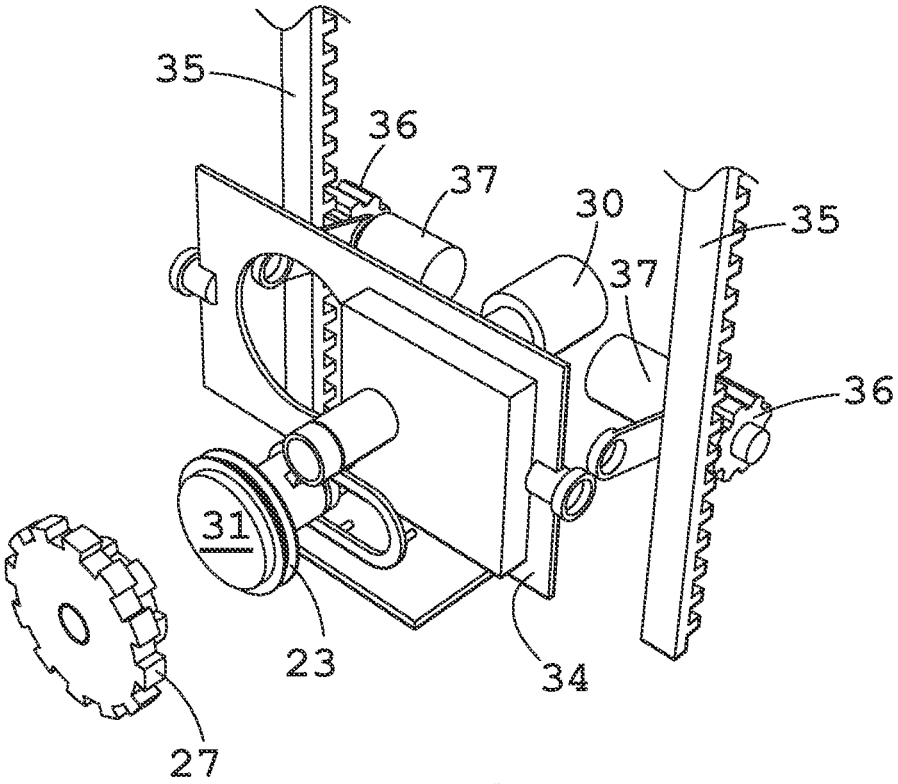
FIG. 4 is a schematic exploded perspective view of part of a primary unit including part of an intermediate plate and linear guides.
Figure 3:
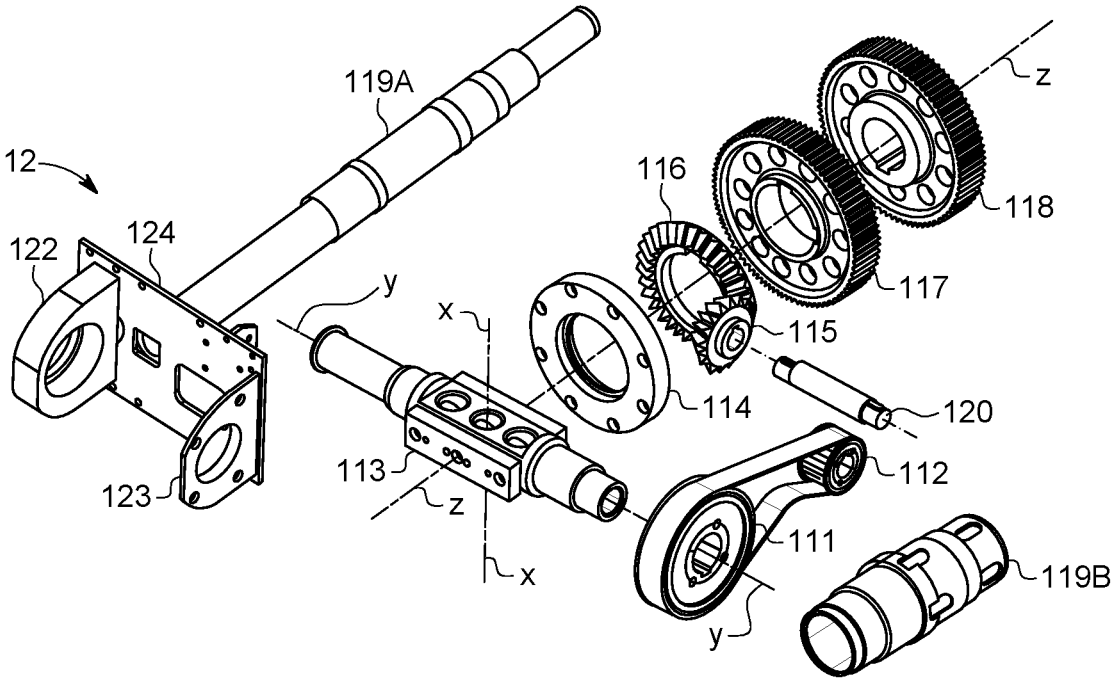
Figure 4:
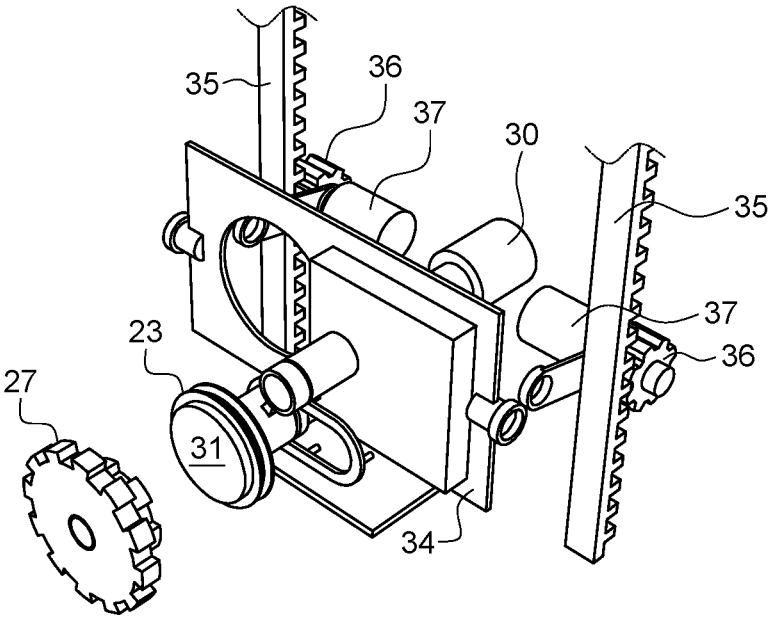
Figure 5:
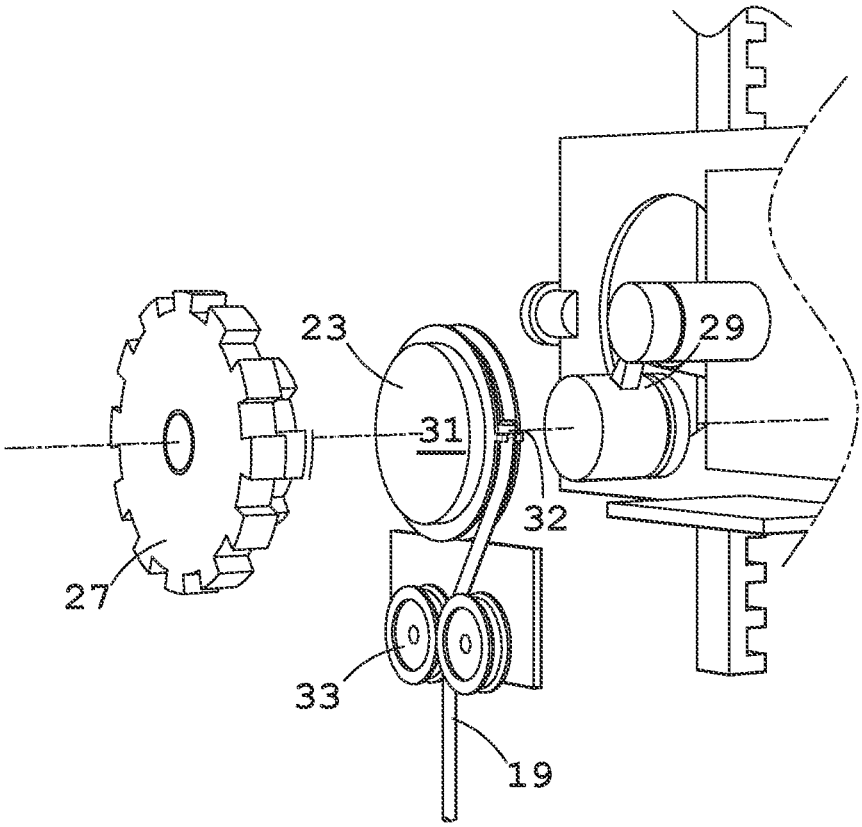
FIG. 5 is a schematic exploded perspective view of part of a primary unit including a drive gear, bidirectional pulley and part of an intermediate plate.
Figure 6:
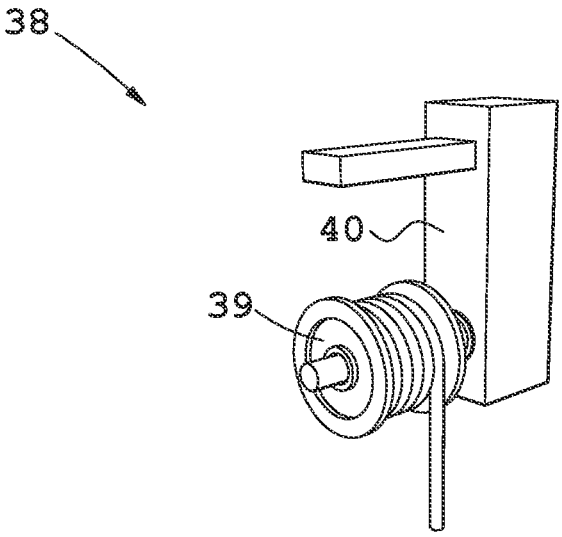
FIG. 6 is a schematic perspective view of part of a compensation mechanism.
Figure 7:
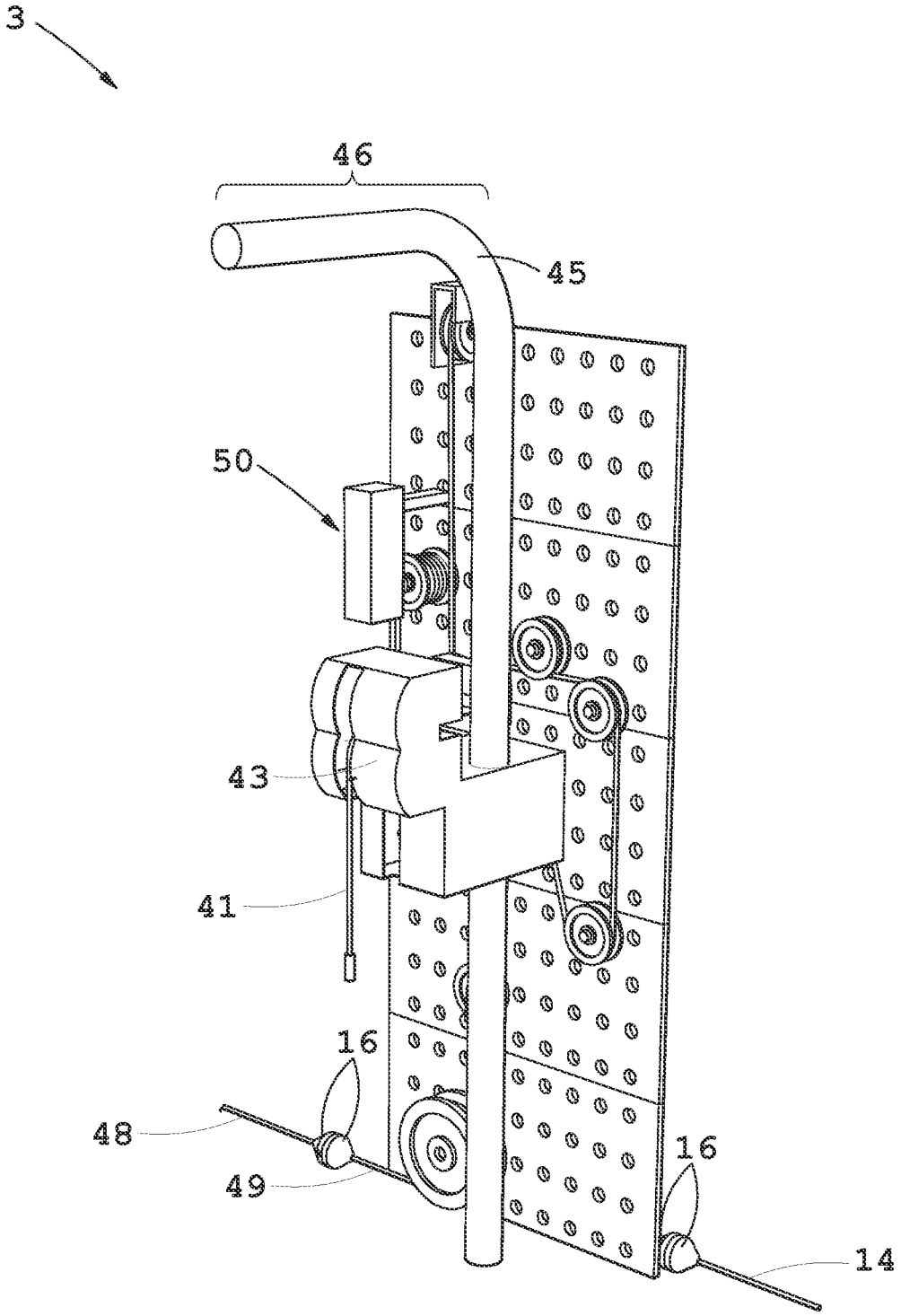
FIG. 7 is a schematic perspective view of part of a primary unit showing the secondary resistance member and related parts.
Figure 8:
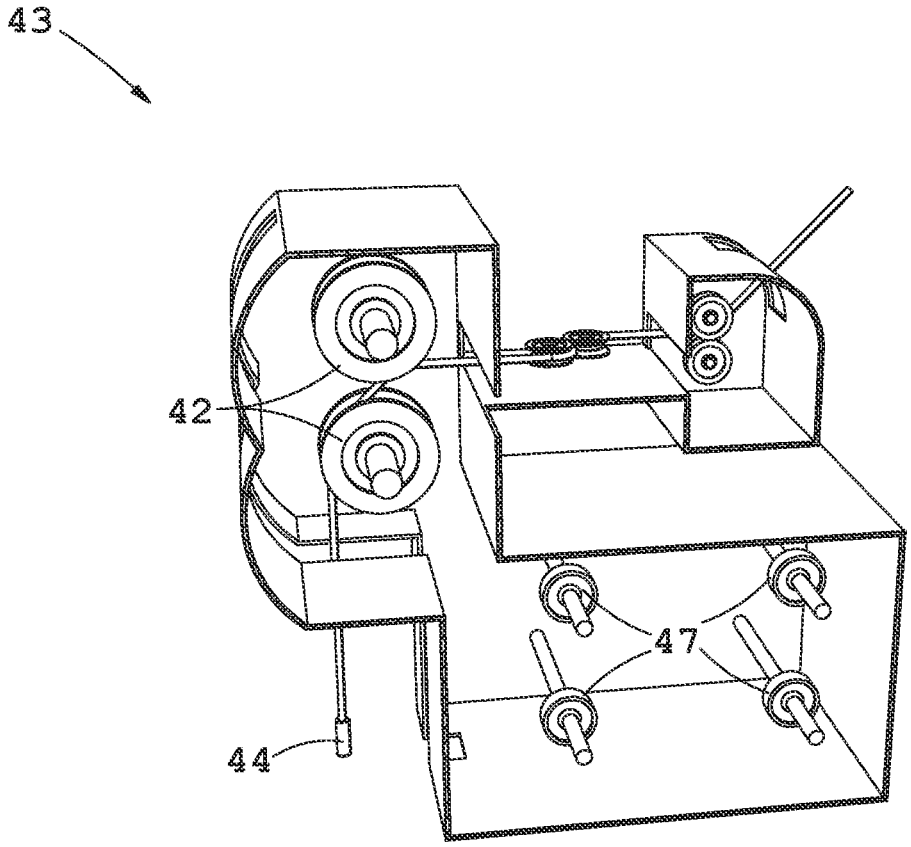
FIG. 8 is a schematic perspective view of a carriage and related parts.

In order to set the arm 5 to a desired rotational position without having the rotation resisted, the rotational movement of the arm 5 may be disconnected from the biasing unit 2 through clutch 24. Clutch 24 may be a traditional frictionally engaged clutch 24 or a dog clutch 24 as shown in FIG. 3. Dog clutch 24 is engaged and disengaged by linear actuator 25 which drives dog clutch 24 into or out of a complementary receptacle in shaft 12. Once clutch 24 is engaged, the rotational position of arm 5 may be adjusted by making use of motor 26 to adjust the rotational position in an automated fashion. Once the position is set, clutch 24 will remain engaged until gear 27 engages with gear 28 after which the clutch can disengage so that arm 5 will resist rotational movement. This ensures that when clutch 24 is engaged, arm 5 is locked to motor 26 allowing arm 5 to be rotated to a desired position and when clutch 24 is disengaged, arm 5 is unlocked from motor 26 and at the same time engaged to the allowing the user to exercise. The resistance is transferred from the bidirectional rotational resistance disk 23 through gears 27 and 28 to shaft 12 and consequently arm 5. Gear 27 may be moved to engage gear 28 through an engaging mechanism 29, driven by motor 30, to move gear 27 into position to mesh with gear 28 such that resistance may be transferred to arm 5.

The bidirectional rotational resistance element 23 allows resistance to be transferred to the arm 5 regardless of the direction of rotation. The element 23 includes a shaft and a circular disk 31 with the end of rope 19 is pivotally attached to the periphery of the disk 31 through a pivot 32. The periphery of the disk includes a groove (similar to that of a pulley, which engages the rope 19 as the disk is rotated. Torsional resistance is created in the element 23 whenever disk 31 is rotated from an equilibrium point (which would be where the pivot is aligned with guide pulleys 33) in either direction. This torsional resistance may be applied over almost a full revolution of the disk 31 in either direction of rotation.

The arm 5 is attached to an intermediate plate 34 within the primary unit 3. The intermediate plate 34 is movable on linear guides, in the form of dual rack 35 and pinion 36 gearsets, which linearly move the intermediate plate 34 up and down within the primary unit to adjust the height of the arm 5. Movement of the plate 34 is facilitated by motors 37 which drive the pinions 36 to move the plate 34. The compensation means 38 ensures that the tension in the rope 19 is maintained as the plate 34 and arm 5 move upwards and downwards and includes a spool 39, wherein one end of the tensioned rope 19 is attached and wound to the spool 39. The spool is driven and held in place by an electric motor 40.

The rotation and movement of the arm 5, engagement of the clutch 24, and all other motorized and actuatable parts described above are controlled through an electronic control unit (ECU) 89 which may perform these actions in an automated fashion according to a stored program or in accordance with instructions provided by a user.

The apparatus 1 may include a secondary resistance training member 41 extending from the primary unit 3. The secondary resistance training member 41 is in the form of a traditional cable/rope which may be used for resistance training and is mechanically connected to the biasing unit 2 to resist extension thereof. The rope 41 extends from the unit 3 through two guide pulleys 42 located inside a carriage 43.

Figure 9:
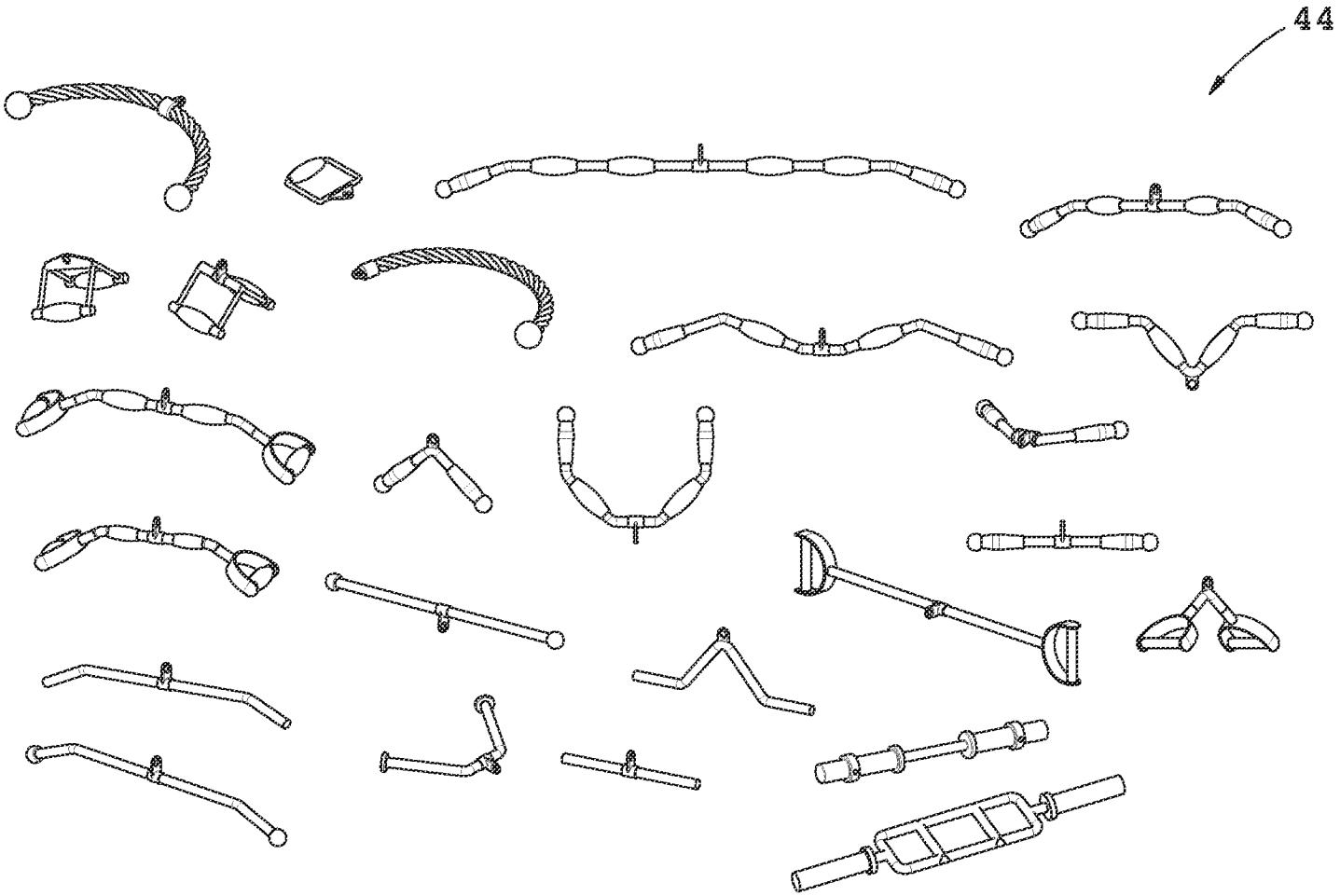
FIG. 9 is a schematic perspective view of a plurality of accessories.
Figure 10:
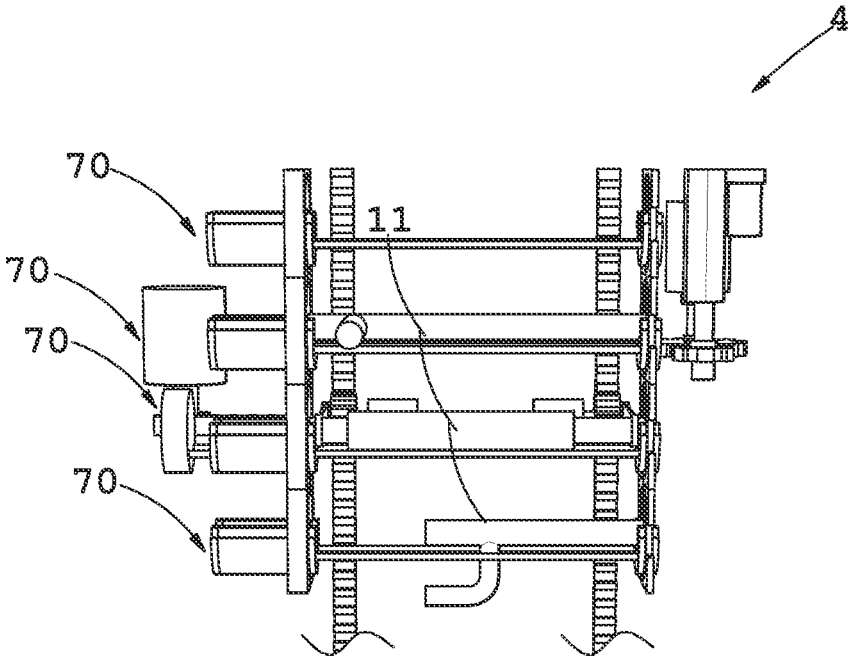
FIG. 10 is a schematic perspective view of part of the internal parts of an accessory exchanger unit.
Figure 11:
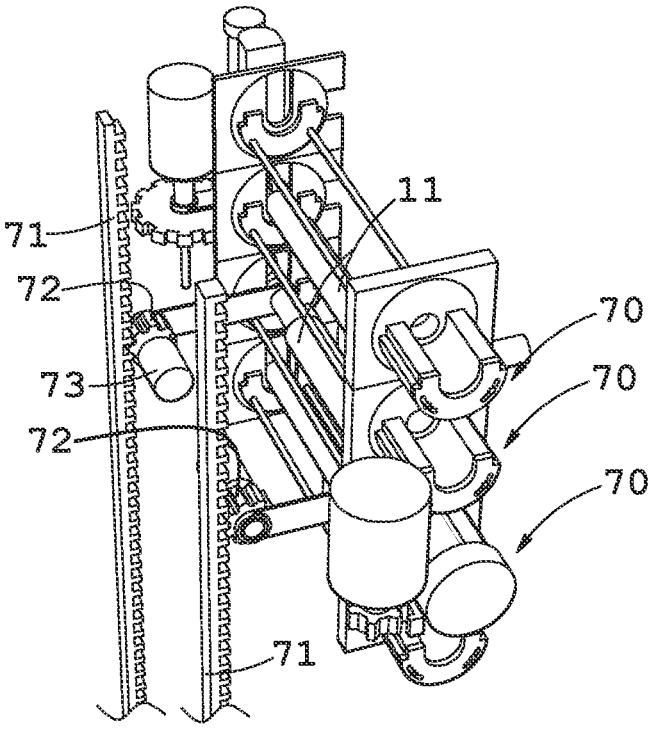
FIG. 11 is a schematic perspective view of part of the internal parts of an accessory exchanger unit.
Figure 12:
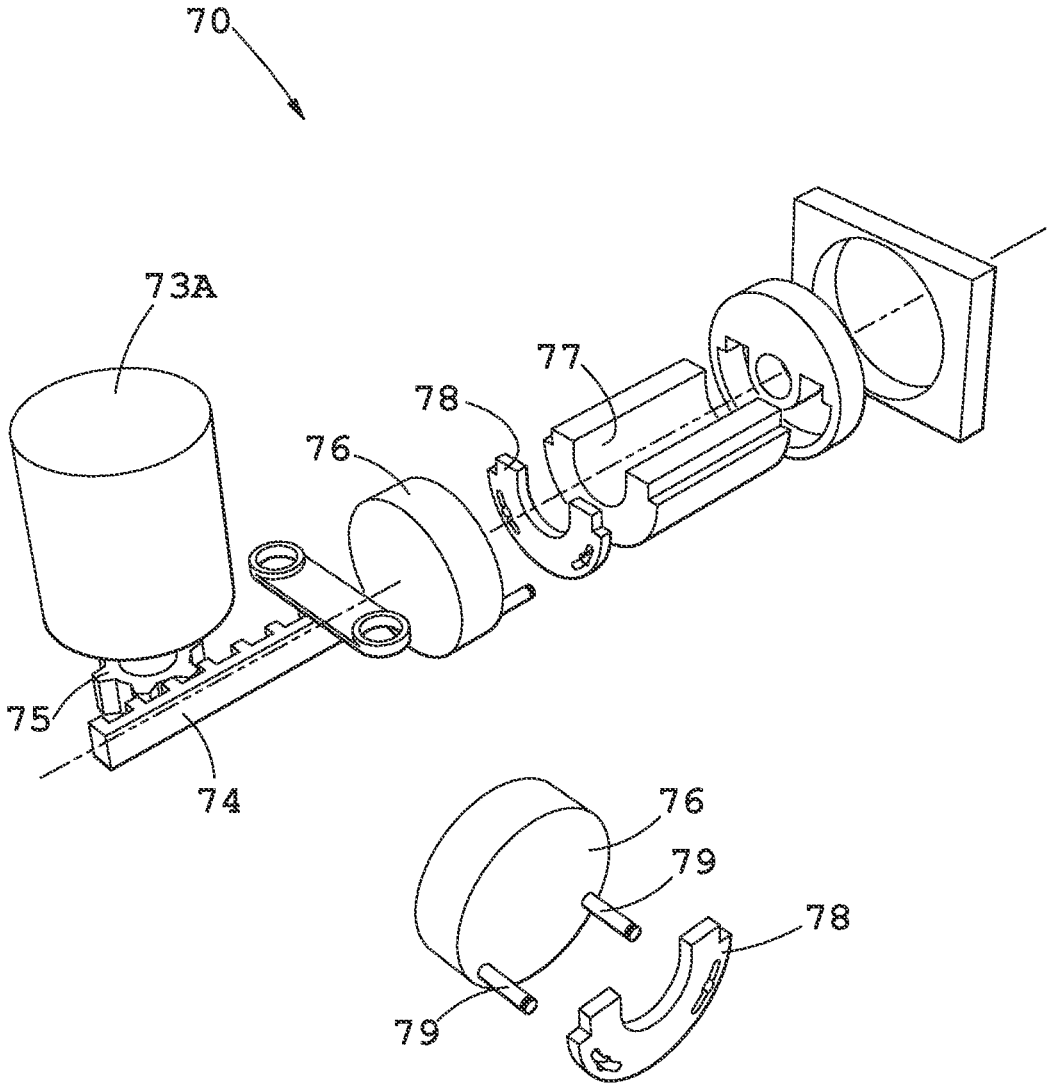
FIG. 12 is an exploded view of part of the internal parts of an accessory exchanger unit.
Figure 13:
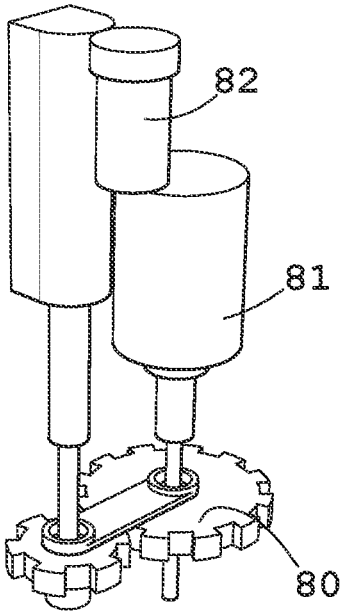
FIG. 13 is a schematic perspective view of part of the internal parts of an accessory exchanger unit.
Figure 14:
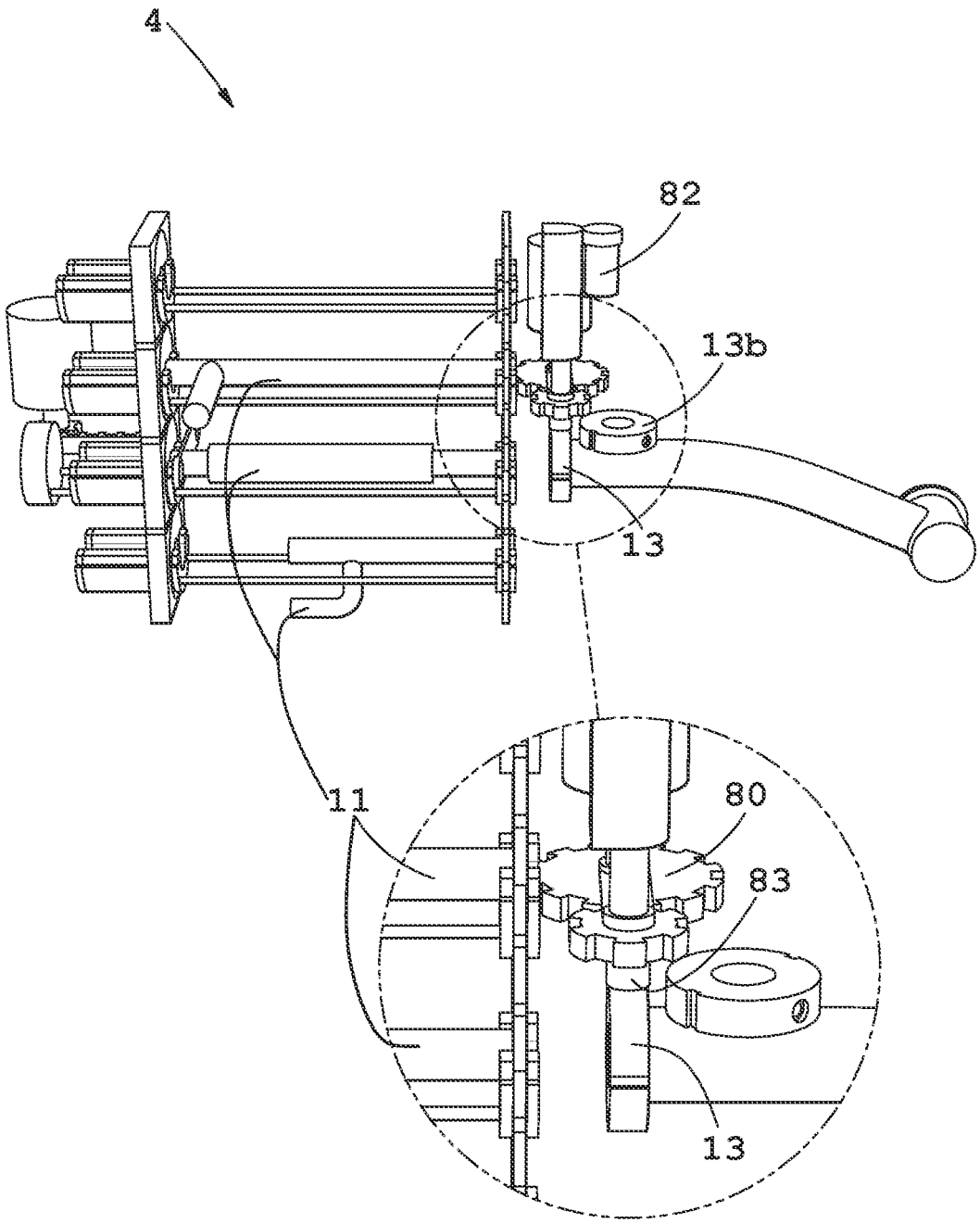
FIG. 14 is a schematic perspective view of part of the internal parts of an accessory exchanger unit and a resistance member being engaged by the accessory exchanger unit, including a detail view showing the engagement of the resistance member.

The free end of the rope may include an accessory attachment element 44 for attaching any one of a number of accessories 44 (as can be seen in FIG. 9) thereto. The accessory 44 may be a handlebar wherein a user engages the handlebar which resists movement through the rope which is useful for traditional cable machine exercises. The carriage 43 is vertically movable along guide rod 45, which includes a horizontal part 46 which extends outside of the primary unit 3. The carriage 43 travels along the guide pole 45 on rollers 47 which may be spring-loaded to engage the pole 45. The biasing unit 2 for the secondary member 41 is similar to that used for the arm 5. Rope 48 is attached through attachment members 16 to rope 49 through a series of pulleys to interact with compensation means 50 which compensates for the vertical position of the carriage 43. Since there is no need to convert the bias to a rotational movement, the secondary member 43 is essentially directly mechanically connected to the biasing unit 2 through the series of pulleys.

Figure 15:
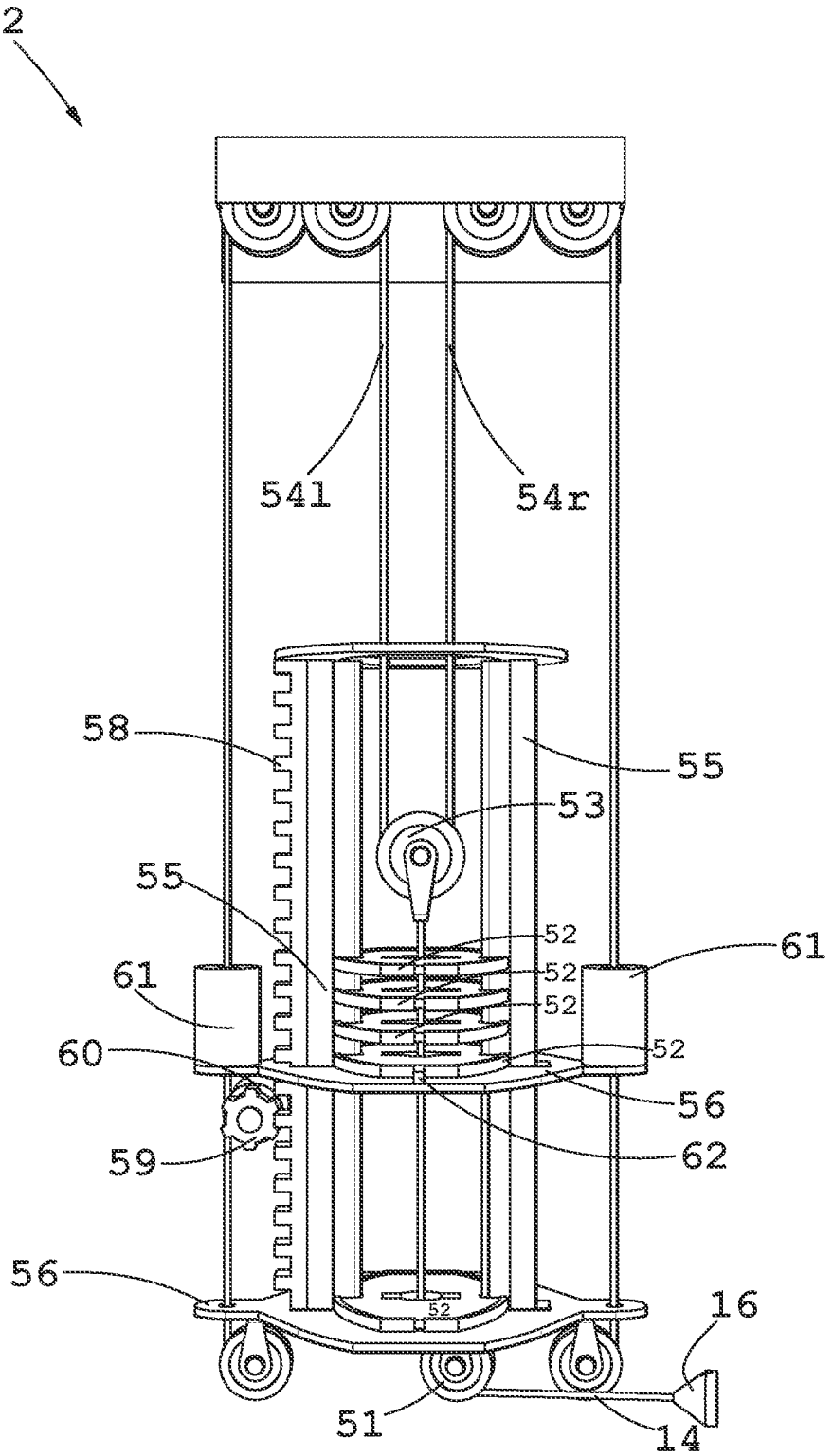
FIG. 15 is a schematic perspective view of the internal parts of a biasing unit.
Figure 16:
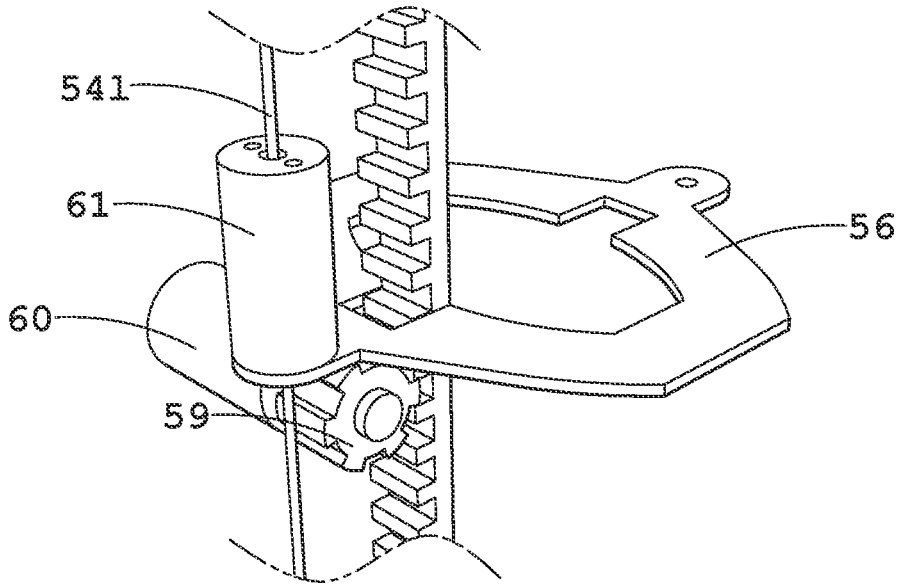
FIG. 16 is a schematic perspective view of the internal parts of a biasing unit.
Figure 17:
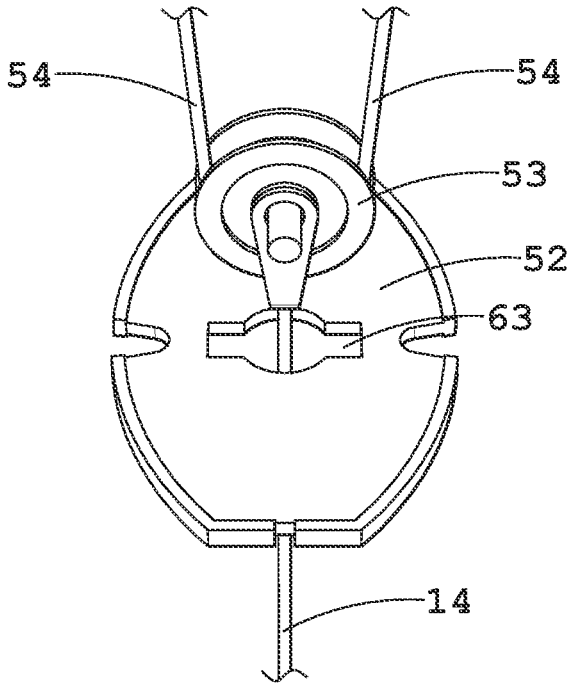
FIG. 17 is a schematic perspective view of a weight and pulley.
Figure 18:
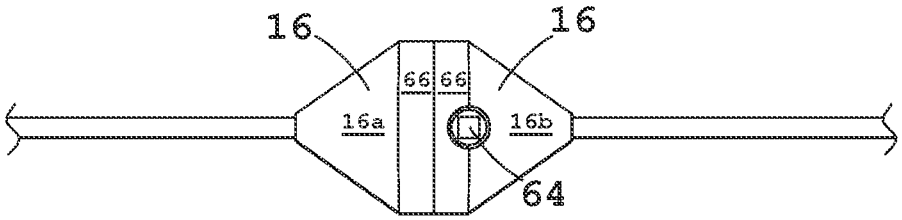
FIG. 18 is a schematic side view of complementary interlocking attachment members in an interlocked configuration.
Figure 19:
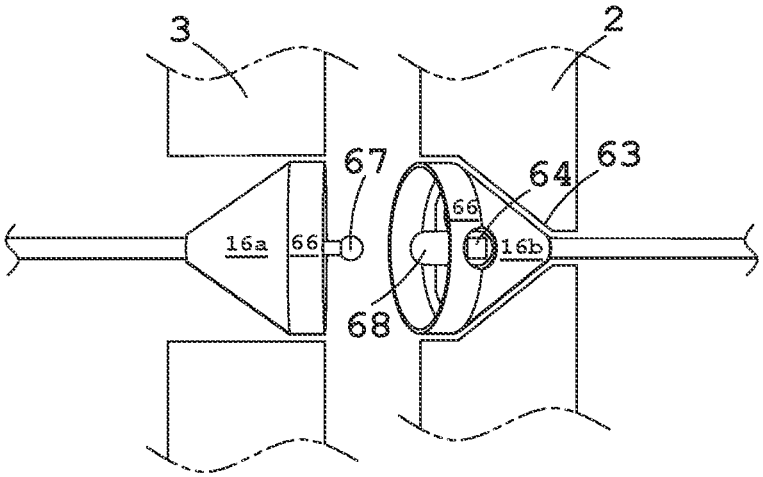
FIG. 19 is a schematic view of complementary interlocking attachment members which are disengaged.
Figure 20:
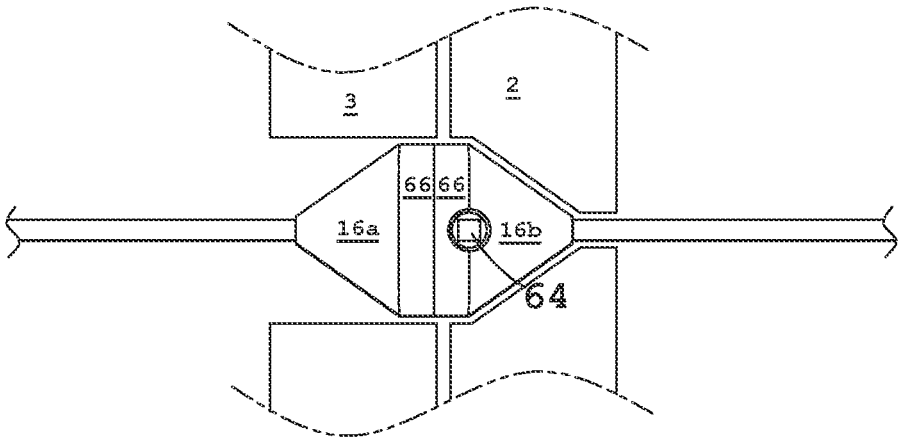
FIG. 20 is a schematic side view of complementary interlocking attachment members in an interlocked configuration.
Figure 21:
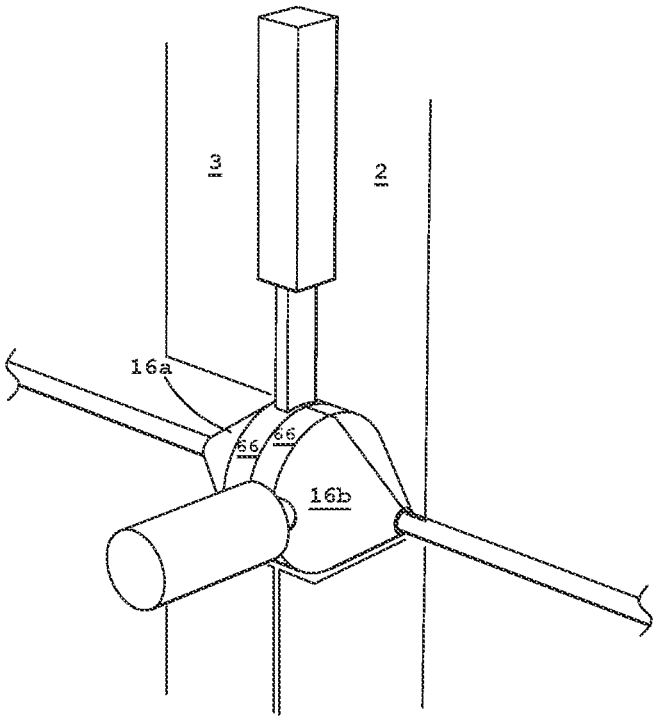
FIG. 21 is a schematic perspective view of complementary interlocking attachment members in an interlocked configuration showing an actuator.
Figure 22:
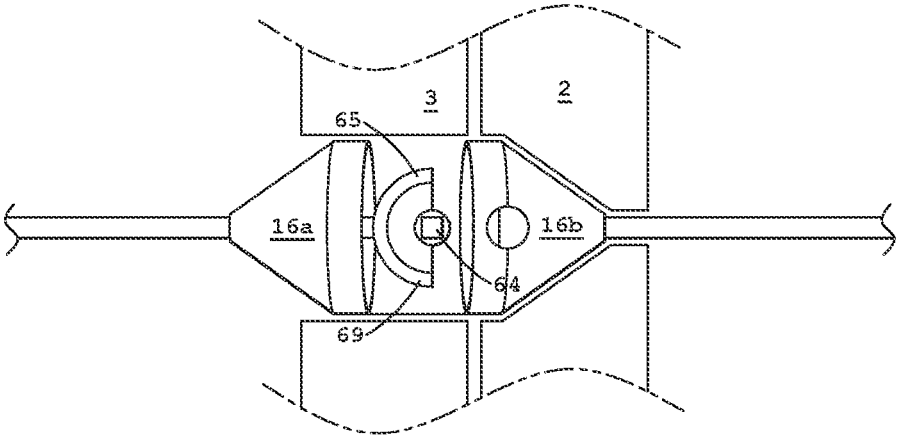
FIG. 22 is a schematic side view of complementary interlocking attachment members.
Figure 23:
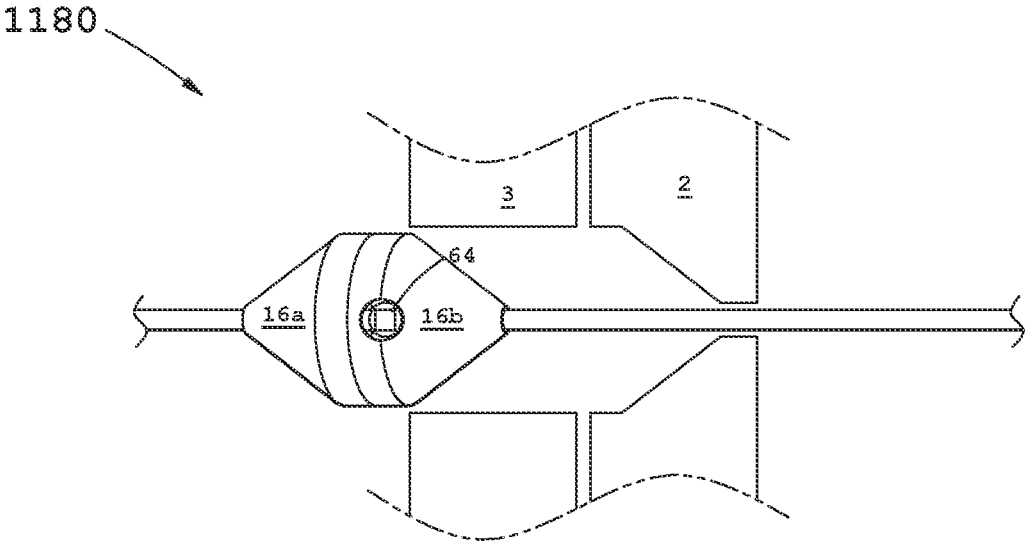
FIG. 23 is a schematic side view of complementary interlocking attachment members in an interlocked configuration in use.

Biasing units 2 are removably connected to a primary unit 3 through complementary interlocking attachment members 16. The biasing units 2 have an output rope which attaches to an input rope on the primary unit 3 in order to provide the necessary resistance for exercises on the primary unit. Whilst this bias may be produced in many ways, for example, using electric servo motors or spring banks to bias the output, the example described herein makes use of a traditional weight stack and ropes which are controlled in an automated fashion. The internal parts of biasing unit 2 described in this example is shown in FIG. 15. The output from the biasing unit 2 is a rope 14 which terminates in an attachment member 16 which may be attached to a complementary member 16 on the input side of the primary unit 3 as described above. Rope 14 engages central pulley 51 such that rope 14 extends through stacked pallet weights 52 towards balancing pulley 53 which balances the tension in rope 14 between the two sides of rope 54 (the left side of rope 54 referred to herein as 54*l* and the ride side referred to as 54*r*). The weights are stacked along linear guides 55 on either side of the weights 52 on top of base 55. A carriage 56 may traverse the guides 55 through a rack 58 located adjacent to one of the guides 55 which is engaged by an opinion 59 driven by motor 60. Two gripping actuators 61, located about the rope on either side (54*l* and 54*r*) may selectively engage the rope to prohibit the rope from moving without the carriage 43 being lifted along with the ropes.

In order to set the required weight on the biasing unit 2, the gripping actuators 61 disengage the rope and the carriage 43 may move into the correct position to engage the required number of weights. Once the correct position is reached, an actuator 61 engages the required number of weights by inserting a locking member, in the form of a pin 62, therein. The rope 54 is engaged with gripping actuators 61 to secure carriage 43 to the weighted ends of the rope 54. When rope 14 is moved, carriage 43, along with all engaged weights, move upward such that the output rope 14 resists movement or extension. The stacked weights may include a central aperture which is shaped and sized such that the pulley 53 may move through the weights 52. This allows the overall design of the biasing unit to be greatly reduced.

The complementary interlocking attachment members 16 include a hollow frustoconical housing with a rope secured to the apex side of the housing. In this example, the biasing unit 2 has a recess formed therein which is shaped and sized to receive the conical tool end 99 and a stud 100 and serves to self-center and the attachment member 16. This allows attachment between respective units (2 and 3) to be easily achieved and allows such attachment to occur in an automated fashion. One of the interlocking attachment members 16*b* include an actuation socket 64 which, when engaged, actuates the interlocking mechanism 65 to attach and interlock the members to each other. Each attachment member 16 may have magnets embedded in a rim 66 thereof to allow for easy alignment. Inside the housing, one side of the rope may include a ball 67 which fits into and is engaged by a socket 68 on its counterpart. The interlocking mechanism 65 is a semicircular disk with an annular lip 69 which, when actuated through the socket 64, engages a protrusion (not shown) inside the housing of the complementary attachment member 16*a* to interlock the members 16.

The internal components of AXU 4 is shown in FIGS. 10 to 14. The purpose of AXU 4 is to detach, store, and re-attach accessories to one of the accessory attachment elements 13 of arm 5. AXU 4 includes a stack of exchanger slots 70, each equipped with a number of actuators 61 for unlocking, detaching, storing, changing, attaching and locking an accessory 11 to the accessory attachment element 13 of the arm 5. The stack moves upward and downward on dual rack 71 and pinion 72 sets which are driven by motors 73. This allows the stack to be collectively moved and individual slots to be aligned to the arm 5 for attachment.

To attach an accessory 11 to the arm 5, a motor 73A drives a rack 74 and pinion 75 set to drive the accessory selector 76 into the accessory holder 77 to push the accessory 11 into the accessory attachment element 13. A selector engagement slot 78 is provided to lock the accessory selector pins 79. This allows the accessory selector 76 to engage the accessory 11 with its slot from the arm 5 to detach and retrieve an accessory 11 and store it in the AXU 4.

When an accessory 11 is aligned to the attachment element 13 of the arm 5 a linear actuator 82 drives a tool 83, herein shown as a square key, into a corresponding socket on the attachment element 13. Once engaged, the tool is rotated by motor 81 through gear assembly 80 to fasten and unlock an accessory 11 to and from the arm.

Figure 25:
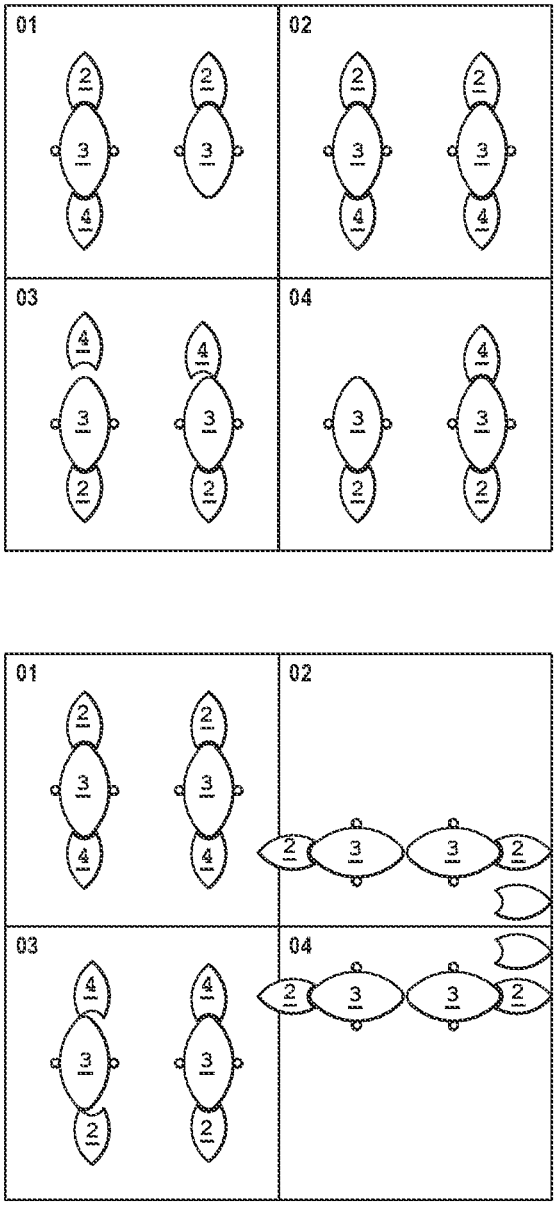
FIG. 25 is a schematic top view of a number of configurations of the primary, biasing, and accessory exchanger units.

Each of the primary 3, biasing 2, and accessory exchanger 4 units include motorized wheels to allow the units to be independently moved and steered. This is useful to allow the apparatus to be arranged into any of the configurations shown in FIG. 25. The units may further include securing formations and mechanisms such that the units may be secured to a base or floor. The units may also be joined with a frame which secures the units in a chosen configuration and such frame may be v-shaped to secure the units in a v-shaped arrangement.

The actuators 25 of the apparatus 1 as described above, including all linear actuators 25, motors, and related components are controlled through a number of electronic control units 89 (ECUs) which include communication means for controlling apparatus 1 from a remote device.

The ECUs 89 may also be connected to sensors which measure movement of the various actuators 61 and parts of the apparatus 1. This is useful to keep track of exercises performed. The apparatus may be controlled through a user interface 400 which may be accessed from a number of devices such as, a tablet 84, smartphone 85, laptop 86, or desktop computer 87.

Each of these devices will be able to access a database 88 which may store details of exercises performed by users and the configuration of the apparatus 1.

The user interface 400 will typically include controls which allow the user to control and actuate the automated aspects of the apparatus described above. For example, the user may control the apparatus by moving each of the units, through their motorized wheels, to position the apparatus 1. Where the attachment of units is automated, a user may engage and disengage biasing unit 2 to a primary unit by actuating the complementary interlocking members. The user may adjust the rotational position and height of the arm 5, adjust the weight for biasing unit 2, and initiate an exchange of an accessory 11. Whilst it is possible for a user to perform these actions manually, it is also desirable that the actions be performed in an automated fashion by running a program to configure apparatus 1 for a specific exercise which is set up for a specific user.

In use, a user will use their device to access the features of the apparatus 1. The user will create a profile which may include the name of the user along with dimensions such as weight and height. The user will select a specific exercise to perform on the apparatus 1. The AXU 4 will move into position to remove a previous accessory 11 and install a desired accessory 11 on the arm 5. With accessory 11 engaged, arm 5 will move to the desired height which is calculated from the user's actual height and which is applicable to the selected exercise. The biasing unit 2 will engage the desired weight which is appropriate for the exercise selected by the user.

The user may then perform the selected exercise, in accordance with instructions which may be provided on the device. The details of the exercise, along with weight, time, speed, range, and number of repetitions will be stored and may be associated with the user's profile. This also allows a performance measurement to be performed and recommendations to be made for future exercises of the user.

The rotation and movement of arm 5 and the engagement of clutch 24 may be actuated and controlled through control unit 89 which is preferably an electronic control unit 89 (i.e., ECU) 89 which controls electric motor 40.

Biasing unit 2 may include stacked weights which may be selectively engaged to adjust the weight such that the bias may be transferred through a rope and pulleys. The free end of the rope may include one of the complementary interlocking attachment members which is attachable to its counterpart on primary unit 3.

Biasing unit 2 may include actuators 25 which are moveable relative to the stacked weights and may selectively engage a number of stacked weights by inserting a locking member to lock a number of weights to the weighted end of the rope. The locking member may be a pin 62.

Actuator 25 is moveable through carriage 43 which moves on linear guides 55 in the form of a rack and pinion. The carriage 43 may be actuated. The actuators 25 may be electric motors which are operated by electronic control unit 89. Carriage 43 may move the actuator 25 to a desired position, such that when the actuator 25 is actuated in the desired position, a number of weights are locked to the weighted end of the rope. The carriage 43 may include engaging members (engaging mechanism 29) to engage the weighted end of rope 19 such that, when the free end of rope 19 is extended, carriage 43 moves upward along with the selectively engaged weights 52 to resist extension of the free end.

Figure 24:
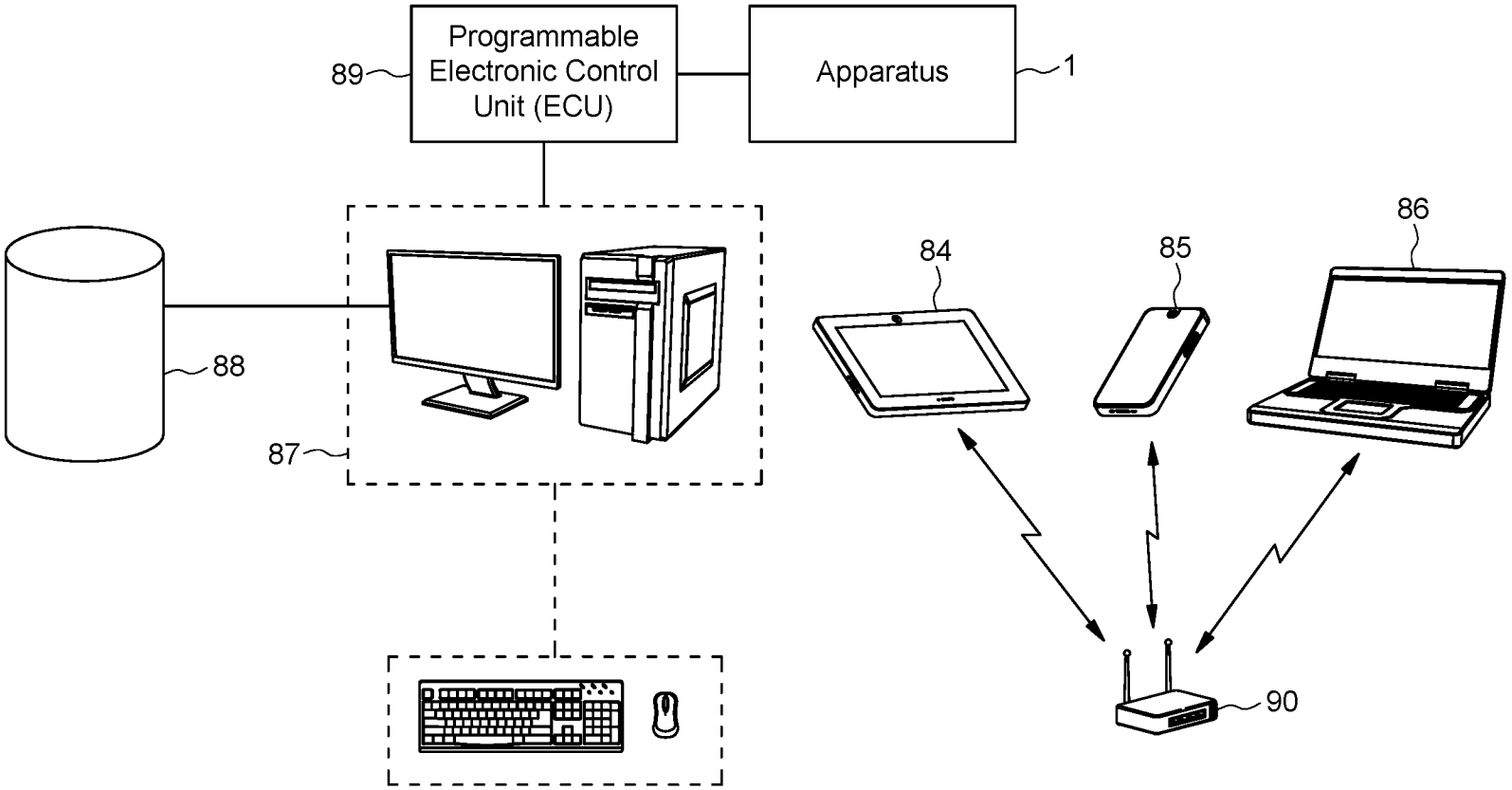
FIG. 24 is a schematic view of electronic devices which may be used to interact with a user interface of the apparatus.

Actuators 25 of apparatus 1 may be controlled through a number of electronic control units 89 (ECUs) which include communication means 300 for controlling apparatus 1 from a remote device (e.g., pad device 84, cellphone 85, laptop computer 86, and the like) of FIG. 24. ECUs 89 may also measure movement of various actuators 25.

It is envisaged that the invention will provide a resistance training apparatus which is modular and can facilitate a wide variety of strength training exercise for users on a single machine. This allows the apparatus to be used in many different configurations and conserves valuable floor space in a gym. The apparatus also enables automation of various tedious tasks which are currently associated with conventional resistance training equipment and allows users to store information about exercises performed with the apparatus.

The invention is not limited to the precise details as described herein. For example, instead of using rack and pinion guides, linear rails and actuators 25 may be employed to move various subassemblies of the apparatus. Further, instead of using gears and gearset, belts and pulleys may be used to achieve the same effect. Similarly, instead of weights being used for resistance, electric motors or springs may be used. The examples described herein provide for separate primary, biasing, and accessory 11 exchanger units 4, however, these units need not be separate and may be different integrated parts of a single unit with motorized wheels so it may be collectively moved.

The invention claimed is:

1. A resistance training apparatus, comprising: a primary unit including a resistance training member pivoted on two shafts, a first shaft and a second shaft, said first shaft being hollow and concentrically enclosing said second shaft, said second shaft being solid; said resistance training member being movable longitudinally along with said primary unit and securable at a position along an axis of longitudinal movement; said resistance training member being rotatable about two axes, a first axis and a second axis, said first axis being perpendicular to said axis of longitudinal movement and said second axis being perpendicular to said longitudinal axis, and rotationally settable to a desired position such that, when said resistance training member is set to the desired position, said resistance training member is mechanically connected to a weight bearing biasing unit, said weight bearing biasing unit resisting rotation of said resistance training member, and where said resistance training apparatus is controlled by means of an electronic control unit, said resistance training member being a movable arm securable longitudinally along the height of said primary unit such that said arm may be secured at a desired height and can further be secured against rotation in the longitudinal and transverse directions, said arm including said hollow first shaft and said solid second shaft and said arm being connected to said hollow first shaft by a bevel gear and to said inner solid second shaft and where said arm is rotatable about said hollow first shaft and said solid second shaft and about a shaft in said bevel gear.

2. The resistance training apparatus of claim 1 wherein the arm includes an accessory attachment element for attaching an accessory to said arm.

3. The resistance training apparatus of claim 1 wherein the rotation and movement of said arm and engagement of said clutch is actuated and controlled through a control unit.

4. The resistance training apparatus of claim 3 wherein said control unit is an electronic control unit and said actuation is performed through electric motors controlled by said electronic control unit.

5. The resistance training apparatus of claim 1 wherein said shaft of said arm includes a mechanical connection to said outer hollow first shaft and said inner solid second shaft being alternatively connected to said biasing unit.

6. The resistance training apparatus of claim 1 wherein said apparatus includes an accessory exchanger unit which detaches, stores, and attaches accessories to one of said accessory attachment elements of said arm.

7. The resistance training apparatus of claim 6 wherein said accessory exchanger unit includes a stack of accessory units, each said accessory unit equipped with a number of actuators for unlocking, detaching, storing, changing, attaching and locking an accessory to the accessory attachment element of the arm.

8. The resistance training apparatus of claim 6 wherein said accessory units are connected to a conical member.

9. The resistance training apparatus of claim 8 wherein said remote device is operable for: moving each of said units; engaging and disengaging said biasing unit to a primary unit by actuating said complementary interlocking members; adjusting the rotational position and height of said arm; disengaging said biasing unit from said arm; adjusting height of said carriage of said secondary resistance training member, adjusting the weight to be engaged by said biasing unit; and selecting and initiating the exchange of said accessory.

* * * * *